US006669453B1

(12) United States Patent
Breeden et al.

(10) Patent No.: US 6,669,453 B1
(45) Date of Patent: Dec. 30, 2003

(54) PUMP ASSEMBLY USEFUL IN INTERNAL COMBUSTION ENGINES

(76) Inventors: Robert H. Breeden, 732 Beechwood Dr., Wooster, OH (US) 44691-2747; Peter H. Sheppard, 615 Sheppard Rd., Hanover, PA (US) 17331; Mark A. Sterrett, 5054 Hickory View Dr., Spring Grove, PA (US) 17362

( * ) Notice: Subject to any disclaimer, the term of this patent is extended or adjusted under 35 U.S.C. 154(b) by 28 days.

(21) Appl. No.: 10/143,267

(22) Filed: May 10, 2002

(51) Int. Cl.[7] ..... F04B 17/00

(52) U.S. Cl. ..... 417/364; 417/273; 417/510; 417/547; 184/6.5; 184/26; 184/32

(58) Field of Search ..... 417/273, 307, 417/369, 440, 510, 514, 549; 184/6.5, 6.6, 26, 27.2, 32

(56) References Cited

U.S. PATENT DOCUMENTS

| | | | | |
|---|---|---|---|---|
| 2,796,057 A | | 6/1957 | Dolza | 123/495 |
| 2,882,884 A | | 4/1959 | Scheiterlein | 123/140 |
| 2,890,690 A | | 6/1959 | Dolza | 123/119 |
| 3,709,200 A | | 1/1973 | Reisacher | 123/41.82 |
| 4,054,108 A | * | 10/1977 | Gill | 123/55 R |
| 4,412,513 A | | 11/1983 | Obermayer et al. | 123/55 VE |
| 5,245,970 A | | 9/1993 | Iwaszkiewicz et al. | 123/447 |
| 5,275,539 A | * | 1/1994 | Custer, Jr. et al. | 417/401 |
| 5,398,658 A | | 3/1995 | Mesimaki | 123/509 |
| 5,992,393 A | | 11/1999 | Yoshida et al. | 123/509 |
| 6,210,129 B1 | * | 4/2001 | Stiefel | 417/360 |
| 6,227,167 B1 | * | 5/2001 | Smith et al. | 123/446 |
| 6,314,946 B1 | | 11/2001 | Funakura et al. | 123/509 |

OTHER PUBLICATIONS

Drawings A, B and C showing conventional vee–type diesel engine with high–pressure swash plate pump in vee recess and cover. Date: Prior to Jan., 2002.

SAE Technical Pape Series 930269 "The New Navistar T 444E Direct–Injection Turbocharged Diesel Engine" International Congress and Exposition, Detroit, Michigan 1–5, 1993.

The "Description of the Prior Art" at application pp. 1 and 2 describes a Vee–type diesel engine with a swash plate pump mounted in a chamber in the Vee recess between the cylinder banks, a cover of the chamber and IPR valve on the top of the cover.

* cited by examiner

*Primary Examiner*—Justine R. Yu
*Assistant Examiner*—John F. Belena
(74) *Attorney, Agent, or Firm*—Hooker & Habib, P.C.

(57) ABSTRACT

A pump assembly for mounting a high-pressure oil pump on an internal combustion engine where the pump in the assembly is mounted in a closed chamber and a solenoid controlled valve is mounted outside of the chamber.

19 Claims, 10 Drawing Sheets

PUMP ASSEMBLY USEFUL IN INTERNAL COMBUSTION ENGINES

FIELD OF THE INVENTION

The invention relates to pump assemblies for providing high pressure oil to internal combustion engines. The high pressure oil may be used to actuate solenoid controlled hydraulic fuel injectors, solenoid controlled hydraulic intake and exhaust valves, or both injectors and valves.

DESCRIPTION OF THE PRIOR ART

Conventional vee-type diesel engines using HEUI fuel injectors mounted on a high-pressure swash plate pump in a chamber located in the vee recess between the cylinder banks. A cover closing the top of the chamber, extended over the pump. An injection pressure regulator (IPR) valve was mounted on the top of the cover. The passages extending between the pump and the valve passed through the cover and included a high-pressure passage which delivered high-pressure oil from the pump to the IPR valve, and a drain passage from the IPR valve. The IPR valve was mounted above the cover to facilitate servicing of the valve and permit routing the electrical leads for the valve solenoid outside the chamber.

Location of the pump in pump within the chamber under a cover and with an IPR valve mounted on the outside of the cover caused a number of problems. It was necessary to connect all of the passages extending through the cover to the pump and to the cover. High-pressure connections were required for the high-pressure passage extending from the pump to the bottom of the cover. The passage and the connections had to be sufficiently strong to withstand the high output pressure of the pump. This arrangement was undesirably expensive because of the cost of the high-pressure pipe and high pressure connections.

The cover had to be sufficiently strong and massive to withstand the output pressure of the pump. A high-pressure conduit extending from the pump to t h e bottom of the cover and the high-pressure connections at both ends of the conduit were required and increased the cost of the engine.

Accordingly, there is a need for an improved high-pressure pump assembly for internal combustion engines with hydraulically actuated devices where the assembly includes a pump located in a chamber under a lightweight cover and with a solenoid actuated pressure regulator valve located outside of the cover. The passage leading from the pump to the valve should withstand the high-pressure pump output without the need for a high-pressure conduit and connections.

SUMMARY OF THE INVENTION

The invention is an improved pump assembly particularly useful in a vee-type internal combustion engine with either HEUI fuel injection systems or solenoid controlled, hydraulically actuated intake and exhaust valves or both. The pump assembly includes a strong metal body capable of withstanding high pump output pressures. A high-pressure pump is provided in an inner portion of the body, a solenoid controlled pressure regulator valve is mounted on an outer portion of the body and a circumferential mounting flange is provided between the inner and outer portions of the body.

The pump assembly body is manufactured from high strength cast iron capable of withstanding high-pressure and includes a high-pressure output passage extending from the pump up through the body past the flange to the pressure regulator valve mounted on the outer portion of the body, above the cover. The assembly does not use a high-pressure connecting conduit and connections joining the conduit to the pump and to the cover.

The pump assembly body is manufactured from high strength cast iron capable of withstanding high pressure and includes a high pressure output passage extending from the pump up through the body past the flange to the pressure regulator valve mounted on the outer portion of the body, above the cover. The assembly does not use a high pressure connecting conduit and connections joining the conduit to the pump and to the cover.

Other objects and features of the invention will become apparent as the description proceeds, especially when taken in conjunction with the accompanying drawings illustrating the invention.

DESCRIPTION OF THE PREFERRED EMBODIMENT

Figure 1:
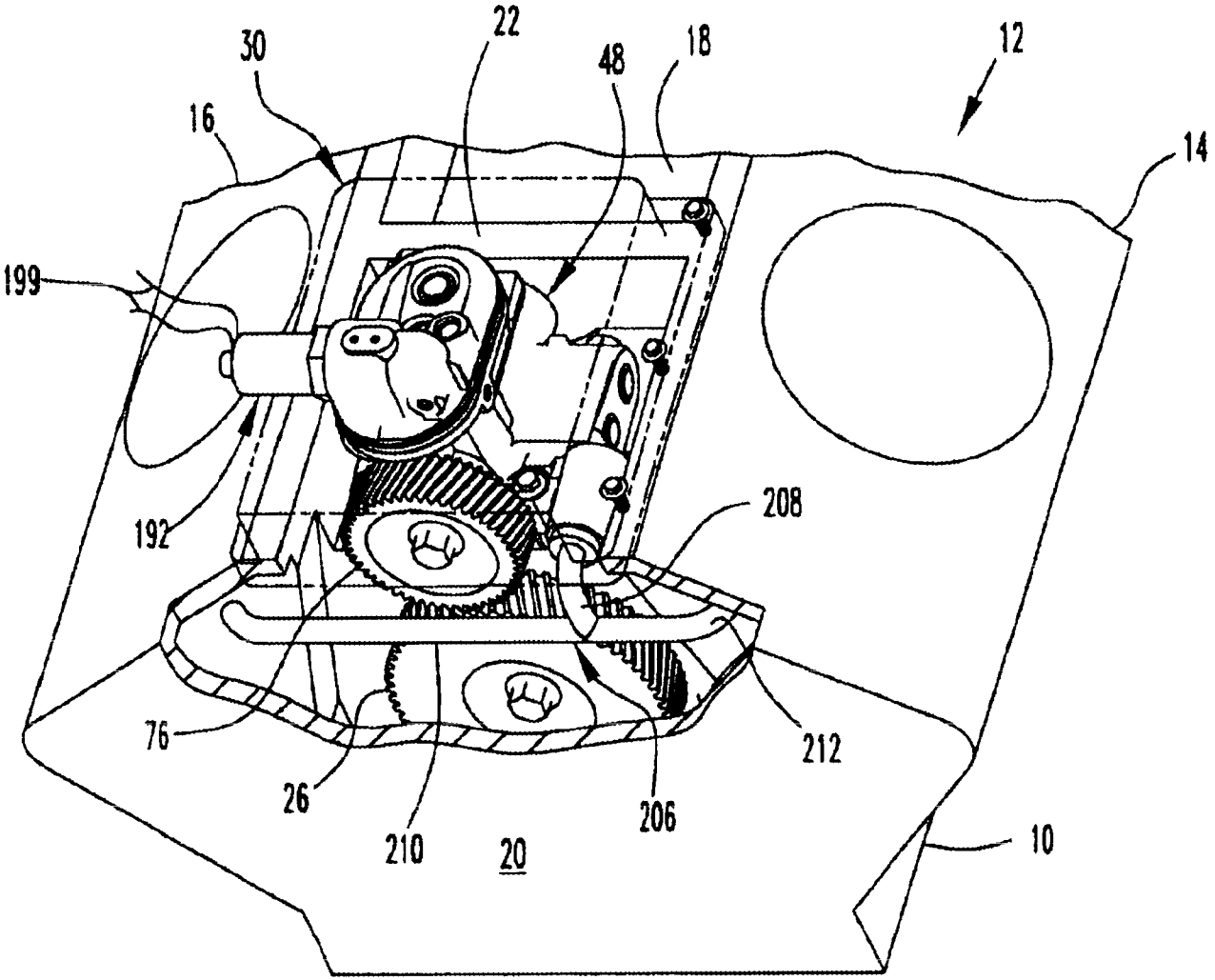
FIG. 1 is a perspective view of the back of the block of a vee engine, partially broken away and the chamber cover in phantom.

FIG. 1 illustrates the rear portion of the block 10 of a vee-type internal combustion engine 12 having a right cylinder bank 14 and a left cylinder bank 16 defining a recess 18 between the two banks. Back wall 20 at the rear of block 10 extends across the recess, and bulkhead 22 extends across the recess a distance inwardly from wall 20. The back wall and bulkhead cooperate with the inner sides of heads 14 and 16 to define block chamber 24 located between the inner walls of heads 14 and 16 and back wall 20 and bulkhead 22. The block 10 includes a camshaft drive gear 26 that is rotated by the engine and extends toward chamber 24 in gear opening 28 defined by the walls of bottom or floor 29 and adjacent to back wall 20.

Figure 2:
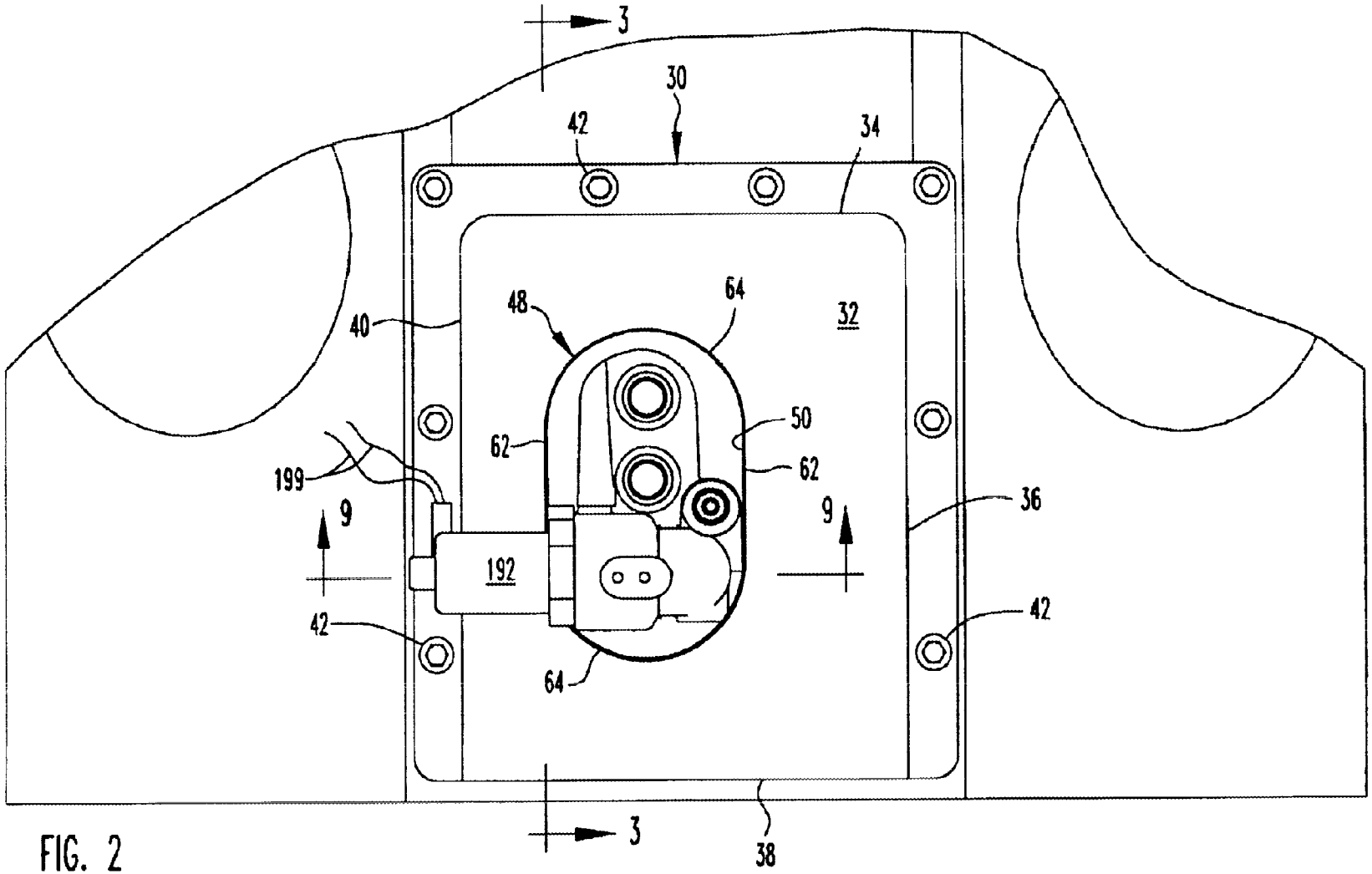
FIG. 2 is a top view of FIG. 1.
Figure 3:
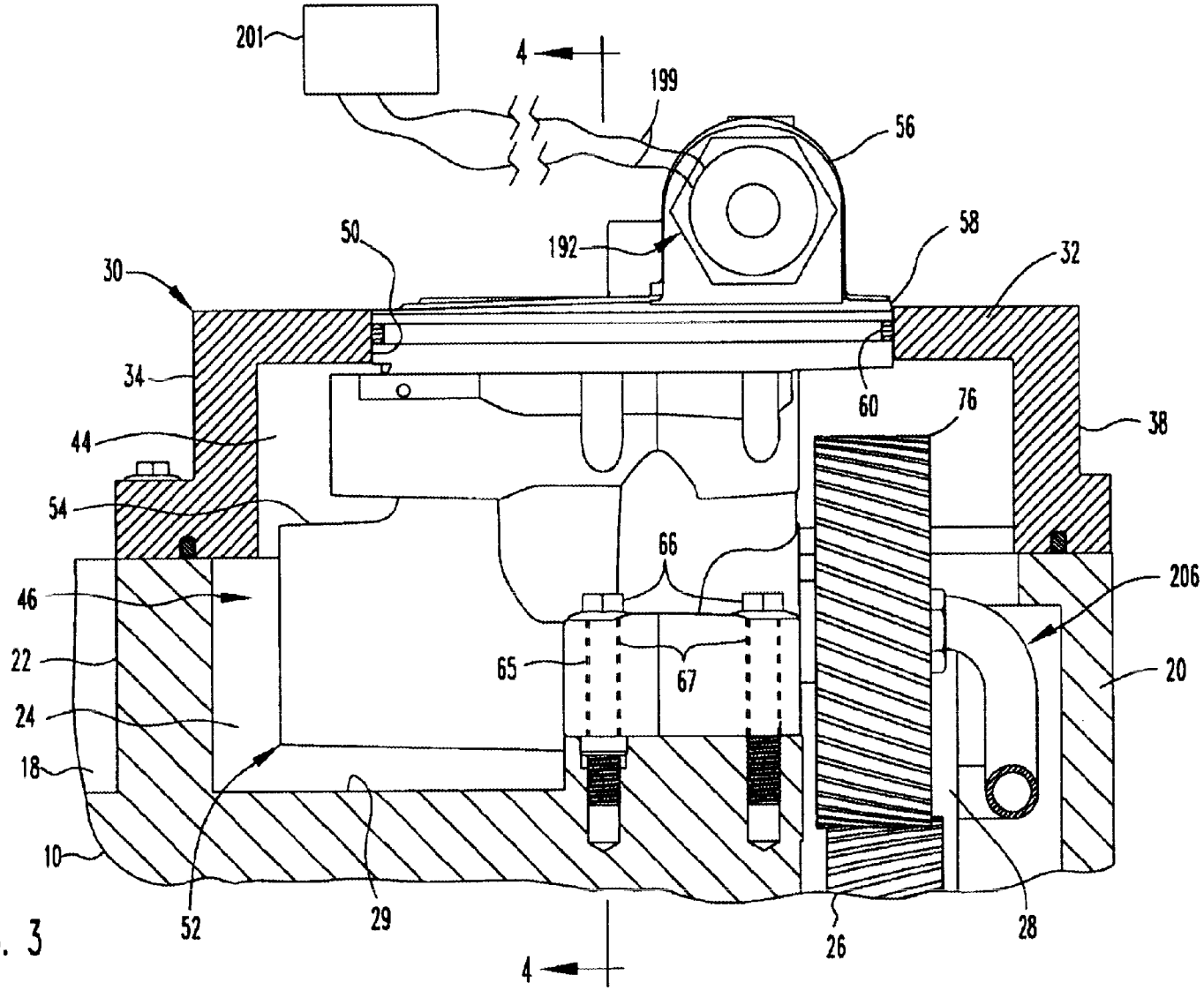
FIG. 3 is a sectional view taken along line 3—3 of FIG. 2.

Light weight chamber cover 30, which may be formed of cast aluminum, overlies chamber 24 and includes a flat top 32 and sidewalls 34, 36, 38 and 40 extending downwardly from the top to bulkhead 22, the adjacent side of cylinder bank 14, the back wall 20 and the adjacent side of cylinder bank 16, respectively. As shown in FIG. 2, cover 30 is rectangular with sidewalls 34 and 38 paralleling each other and sidewalls 36 and 40 paralleling each other. Bolts 42 secure the cover to block 10.

The top and side walls of cover 30 define a cover chamber 44 located above block chamber 24. The cover chamber and block chamber form a single pump chamber 46 extending from the floor 29 of block 10 up to the the top of cover top 32.

Pump assembly 48 is mounted on block 10 in pump chamber 46 and extends upwardly through opening 50 in cover top 32 above the cover. Assembly 48 includes a cast iron body 52 with a first, lower portion 54 located in pump chamber 46, a second, upper portion 56 located above or facing outwardly from cover 30 and a circumferential flange 58 surrounding the body 52 between the upper and lower portions. Flange 58 has a close fit within opening 50 and carries a circumferential sealing gasket 60 that resiliently engages the inner surface of opening 50 to seal chamber 46. As illustrated in FIG. 2, opening 50 and flange 58 have opposed parallel sides 62 extending parallel to the longitudinal axis of block 10 and opposed semicircular ends 64 joining the sides. Body 52 includes a first mounting flange 65 adjacent to the lower portion thereof and a second mounting flange (not illustrated) spaced from flange 65. Two vertical bores 67 extend through flange 65. One bore extends through the the second mounting flange. Three mounting bolts 66 extend through the bores in the flanges to mount the pump assembly to the floor of the pump chamber.

Pump assembly 48 includes a crankshaft 68 having an axis parallel to the axis of the crankshaft of engine 12. Crankshaft 68 is journaled in sleeve bearings 70 and 72 mounted in body 52 and includes a drive end 74 extending outwardly from the back of the body 52. Driven gear 76 is mounted on crankshaft end 74 and meshes with drive gear 26. Gear 26 rotates crankshaft in the direction of arrow 78 shown in FIG. 4.

Figure 4:
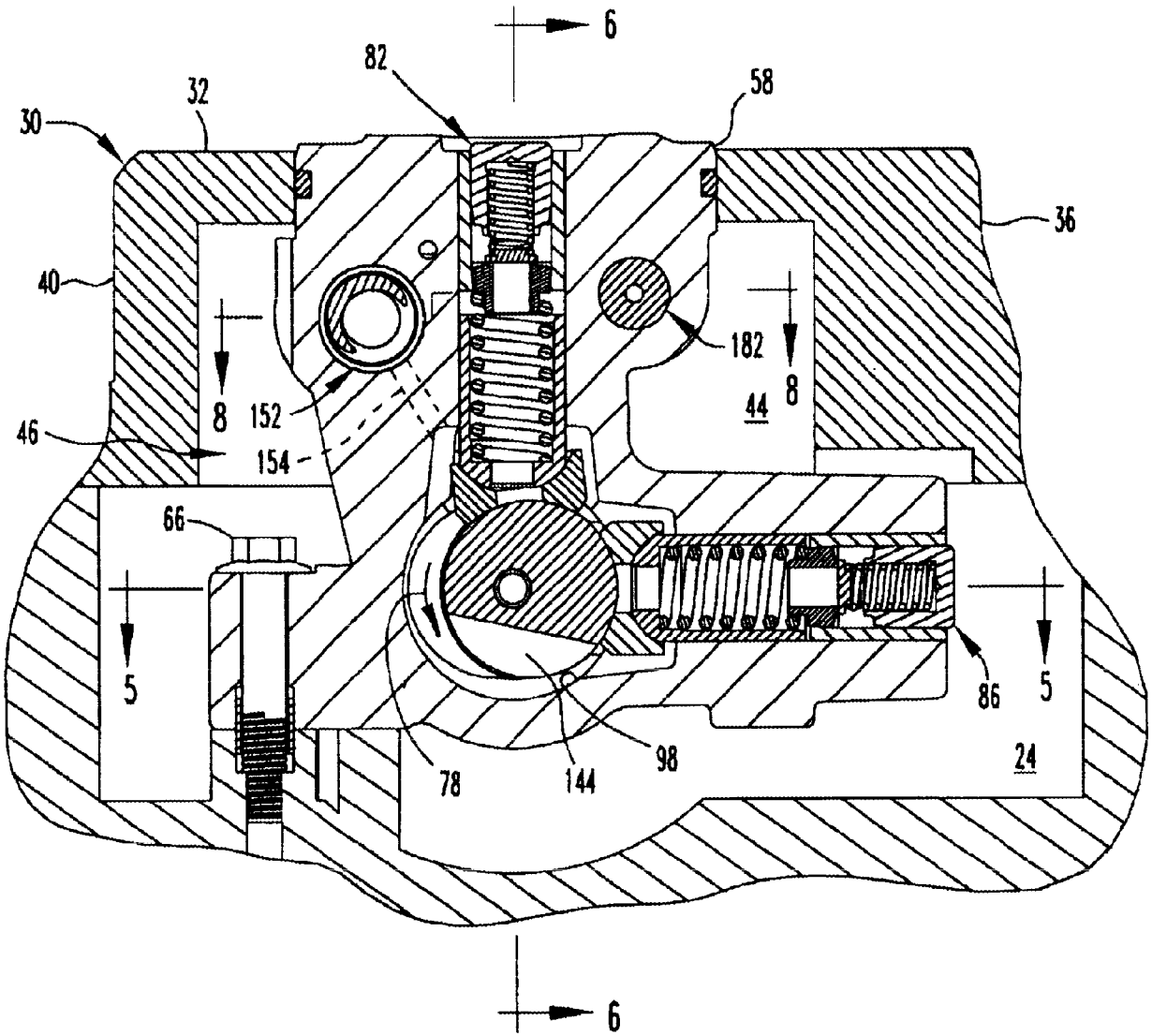
FIG. 4 is a sectional view taken along line 4—4 of FIG. 3.
Figure 5:
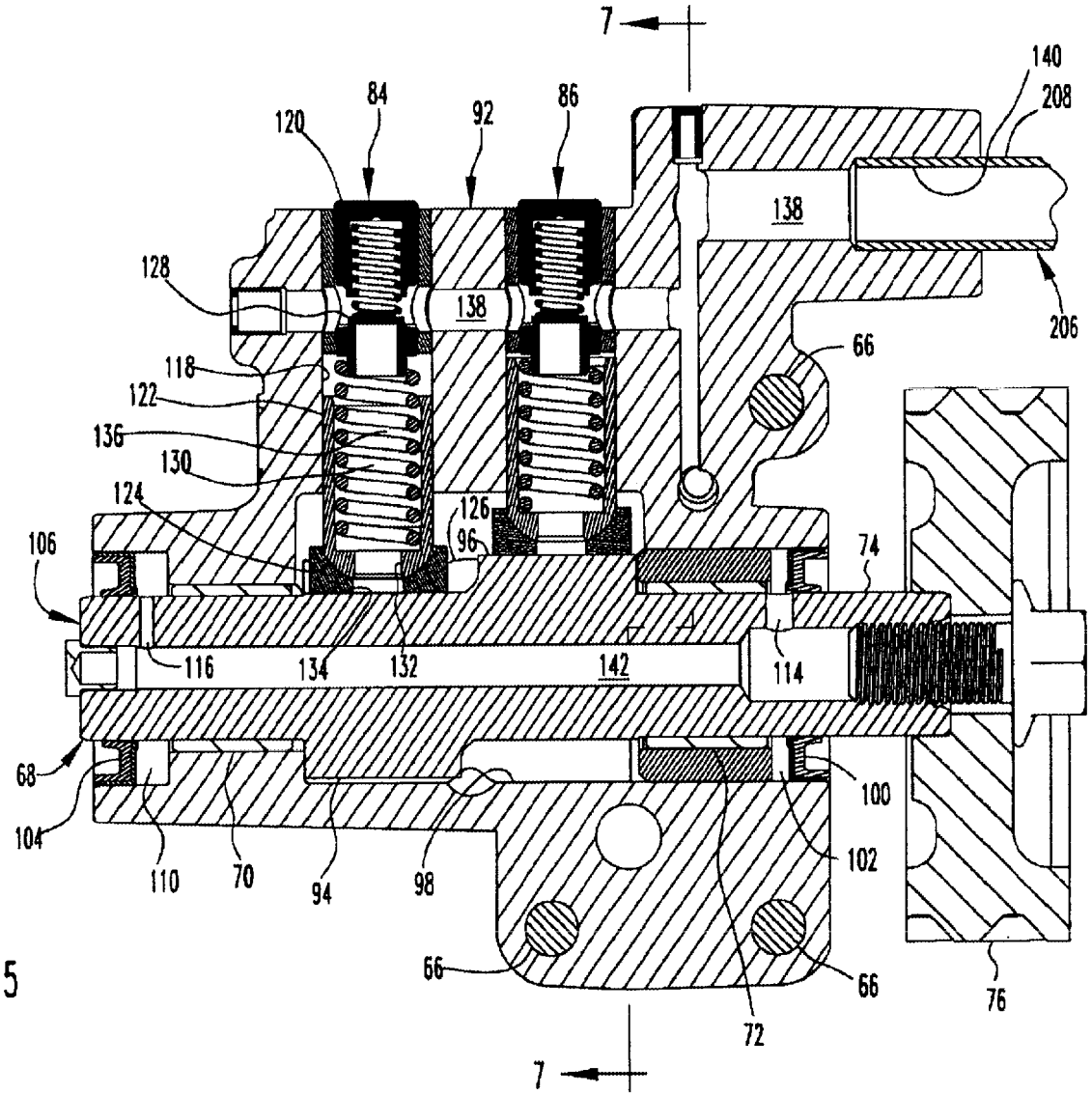
FIG. 5 is a sectional view taken along line 5—5 of FIG. 4.
Figure 6:
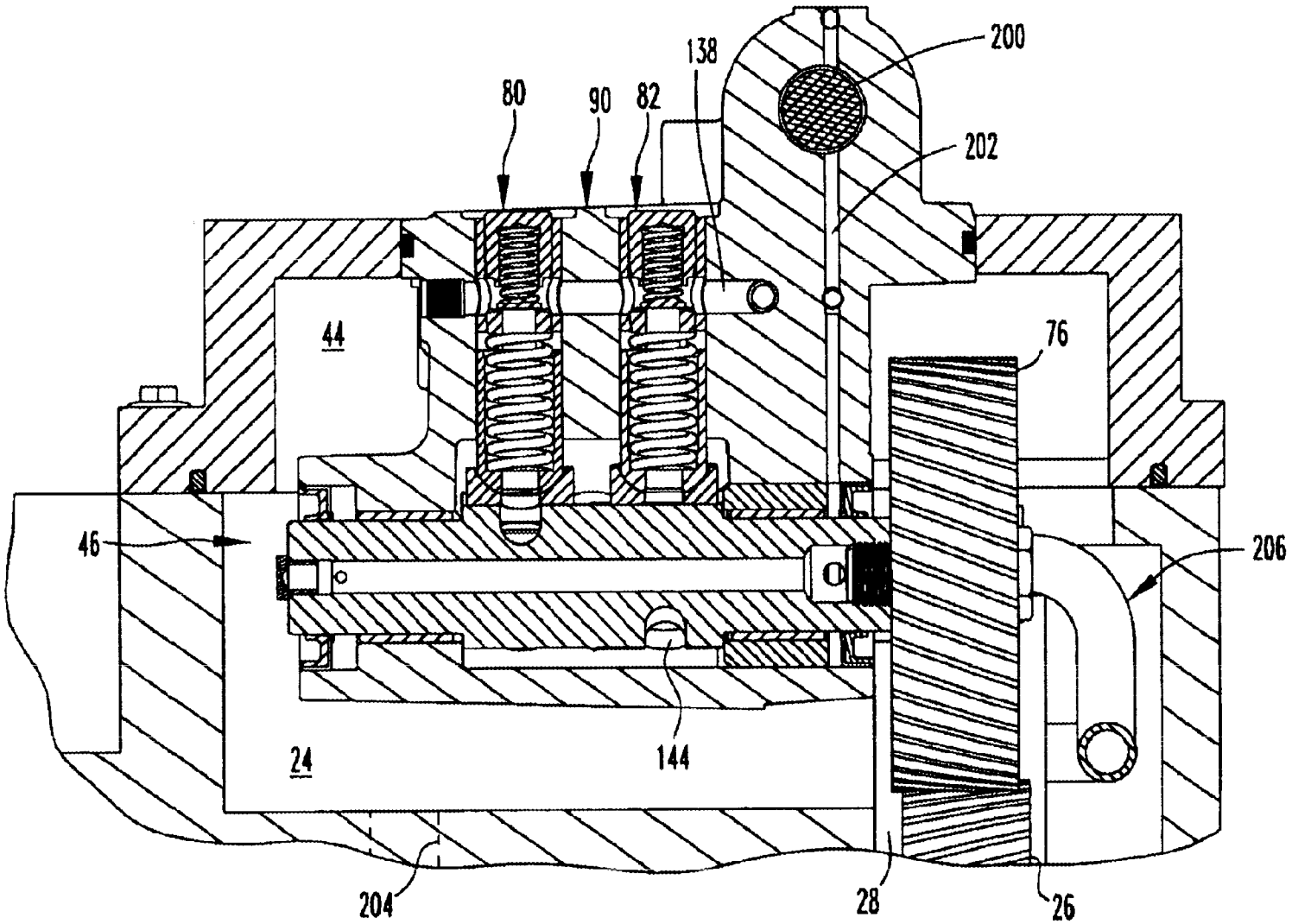
FIG. 6 is a sectional view taken along line 6—6 of FIG. 4.
Figure 7:
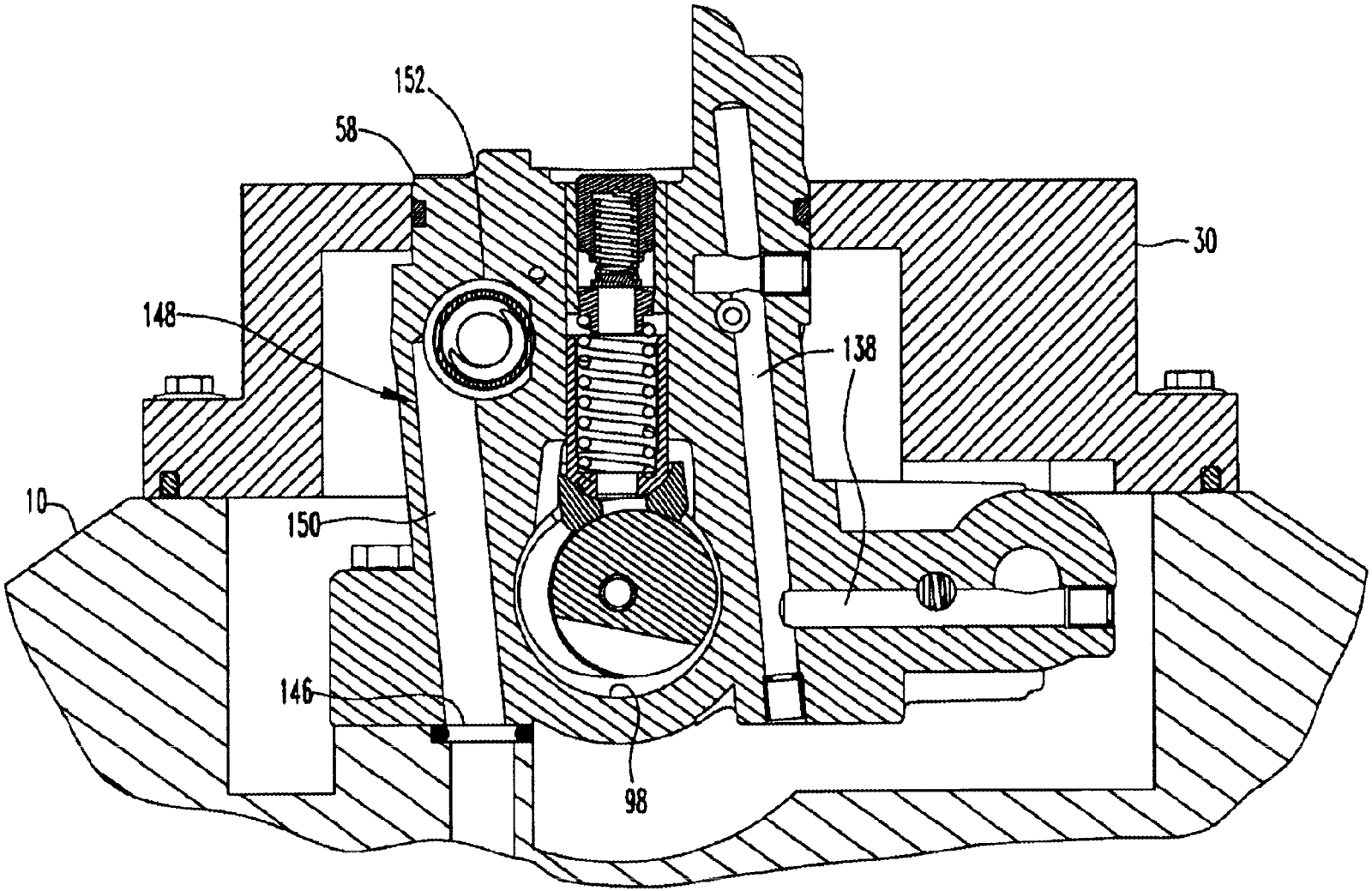
FIG. 7 is a staggered sectional view taken along line 7—7 of FIG. 5.

Pump assembly 48 includes four like high pressure check valve pumps 80, 82, 84 and 86 shown in FIGS. 4, 5 and 6. The high pressure pumps 80, 82, 84 and 86 and the hydraulic circuitry for the pumps are like the pumps and hydraulic circuitry disclosed in PCT Application No. PCT/US01/17142 published Dec. 6, 2001 as WO 01/92709 A2, the disclosure of which is incorporated herein by reference in its entirety.

Pumps 80 and 82 extend vertically above crankshaft 68 in a vertical bank 90 and pumps 84 and 86 extend horizontally from the crankshaft toward the right cylinder head 14 to form a horizontal pump bank 92. Pumps 80 and 84 are located at the same position along the crankshaft and are spaced apart 90 degrees. Pumps 82 and 86 are likewise located at the same position on the crankshaft and are spaced apart 90 degrees around the crankshaft.

The crankshaft carries two axially spaced cylindrical cranks or eccentrics 94 and 96 located in crank chamber 98 formed in body 52, between sleeve bearings 70 and 72. Eccentric 94 drives pumps 80 and 84 and eccentric 96 drives pumps 82 and 86. The eccentrics are 180 degrees out of phase with each other.

Shaft seal 100 is mounted in body 52 and seals the drive end 74 of the crankshaft. Annular chamber 102 surrounds the crankshaft and is located between the seal and sleeve bearing 72. The seal 100 includes an outwardly extending sealing lip permitting oil flowed to chamber 102 to flow out from the pump assembly. Shaft seal 104 is fitted in body 52 and surrounds crank end 106. Seal 104 includes an outwardly extending lip engaging the crankshaft to permit flow of oil from annular chamber 110 outwardly from the pump assembly.

The crankshaft includes an axial passage 112 extending between ends 74 and 106. The ends of passage 112 are closed. Radial passage 114 extends from passage 112 to chamber 102 and radial passage 116 extends from passage 112 to chamber 110. The diameter of passage 116 is less than the diameter of passage 114. The passages restrict flow from chamber 102 to chamber 110. During operation of pump assembly 48 oil is flowed to chamber 102 to provide lubrication for sleeve bearing 72. Oil also flows through passages 114, 112 and 116 to chamber 110 to lubricate sleeve bearing 70. Oil in chambers 110 and 102 lifts the lips of the seals and oil flows out from the body through the resultant openings between the lips and the ends of the crankshaft.

Each pump 80, 82, 84 and 86 includes a radial bore 118 formed in body 52 and extending from the crank chamber to the exterior surface of the body. Plug 120 closes the outer end of bore 118. A hollow cylindrical piston 122 has a close sliding fit in the bore. Partial spherical piston inner end 124 is seated in a partial spherical concave surface formed in slipper 126. The slipper has an inner partial cylindrical surface engaging one of the eccentrics 94, 96. Rotation of the crankshaft moves the pump pistons through pumping and return strokes.

A spring backed outlet check valve 128 is fitted in bore 118 between plug 120 and piston 122. Piston spring 130 is confined between the check valve and piston end 124 to hold the piston against the slipper and the slipper against the eccentric. Central passage 132 extends through piston end 124 and is aligned with passage 134 extending through slipper 126. The interior volume of piston 122 and the bore 118 below check valve 128 form a variable volume pumping chamber 136. A branch of high pressure outlet passage 138 communicates with the piston bores of pumps 84 and 86 between the outlet valves 128 and plugs 120. Another branch of high pressure outlet passage 138 communicates with the piston bores of pumps 80 and 82 between the outlet valves 128 and plugs of the pumps. The outlet passage 138 also communicates with pump outlet port 140. Another branch of high pressure outlet passage 138 extends up past flange 58 to IPR valve spool recess 142 formed in body upper portion 56. Recess 142 is located above flange 58. Outlet port 140 is located below the flange, in pump chamber 46.

An undercut slot 144 is formed in each eccentric. Rotation of the camshaft moves the slots 144 under passages 134 in slippers 126 to provide unobstructed inlet passages extending from the crank chamber 98 into the pumping chamber 136 of each pump during return strokes of the pistons. In FIG. 5, the piston of pump 86 is in the fully extended position and the piston of pump 84 is in the fully retracted position.

Pump assembly 48 includes a low pressure inlet port 146 and an inlet passage 148 having a branch 150 extending from port 146 to inlet throttle valve 152 and a branch 154 extending from the inlet throttle valve to the crank chamber 98.

The inlet throttle valve 152 includes a cylindrical bore 156 extending between exterior faces 158 and 160 of body 52 providing bore 156 with open ends on opposite sides of body 52. This construction facilitates machining of the bore very accurately with a tool extending completely through the bore from one end to the other. This permits a precision fit of the inlet throttle valve spool in the bore. Provision of an open ended bore also facilitates flushing away of cuttings from the body following completion of the machining process.

The inlet throttle valve 152 includes a plug 162 closing the end of the bore adjacent face 158 and plug 164 closing the end of the bore adjacent face 160. Hollow cylindrical inlet throttle valve spool 166 is fitted in bore 156 between the plugs and includes a closed end 168 adjacent plug 162 and a central post 170 extending outwardly from the closed end to define an annular chamber 172 surrounding the post when the spool is in the position shown in FIG. 8.

An inlet throttle valve spring 178 is mounted in bore 156 and extends from plug 164 through the interior of the cylindrical spool to closed end 168. The spring normally biases the spool toward the full open position shown in FIG. 8 where pin 170 engages plug 162.

The inlet passage branch 150 opens into bore 156 adjacent plug 164 to flow low pressure oil into the interior of the spool. A number of inlet flow openings 176 are formed through the thickness of the cylindrical portion of inlet throttle valve spool 166, with the largest openings 176 adjacent plug 164 and smaller openings adjacent plug 162. The spool at all times extends completely across chamber 174 with the openings 176 opening into the chamber permitting low pressure oil to flow from inlet port 146 through inlet passage 148 and to the crank chamber. Chamber 174 forms the upstream end of inlet passage segment 154 leading to the crank chamber.

Spring 178 is confined in bore 156 between plug 164 and the closed end of spool 166. The spring normally biases the spool to the fully open position shown in FIG. 8 with post 170 engaging plug 162 and large openings 176 in the spool communicating with chamber 174 to permit maximum flow of low pressure oil to the crank chamber.

Passage 180 extends from inlet throttle valve spool recess 142 in body upper portion 56 down past flange 58 to chamber 172 in the inlet throttle valve. Fluid flowed through passage 180 into chamber 172 shifts the spool away from plug 162 to decrease the area of the openings 176 opening into chamber 174 and correspondingly decrease or throttle the flow of inlet oil into the crank chamber and pumps 80, 82, 84 and 86.

Figure 8:
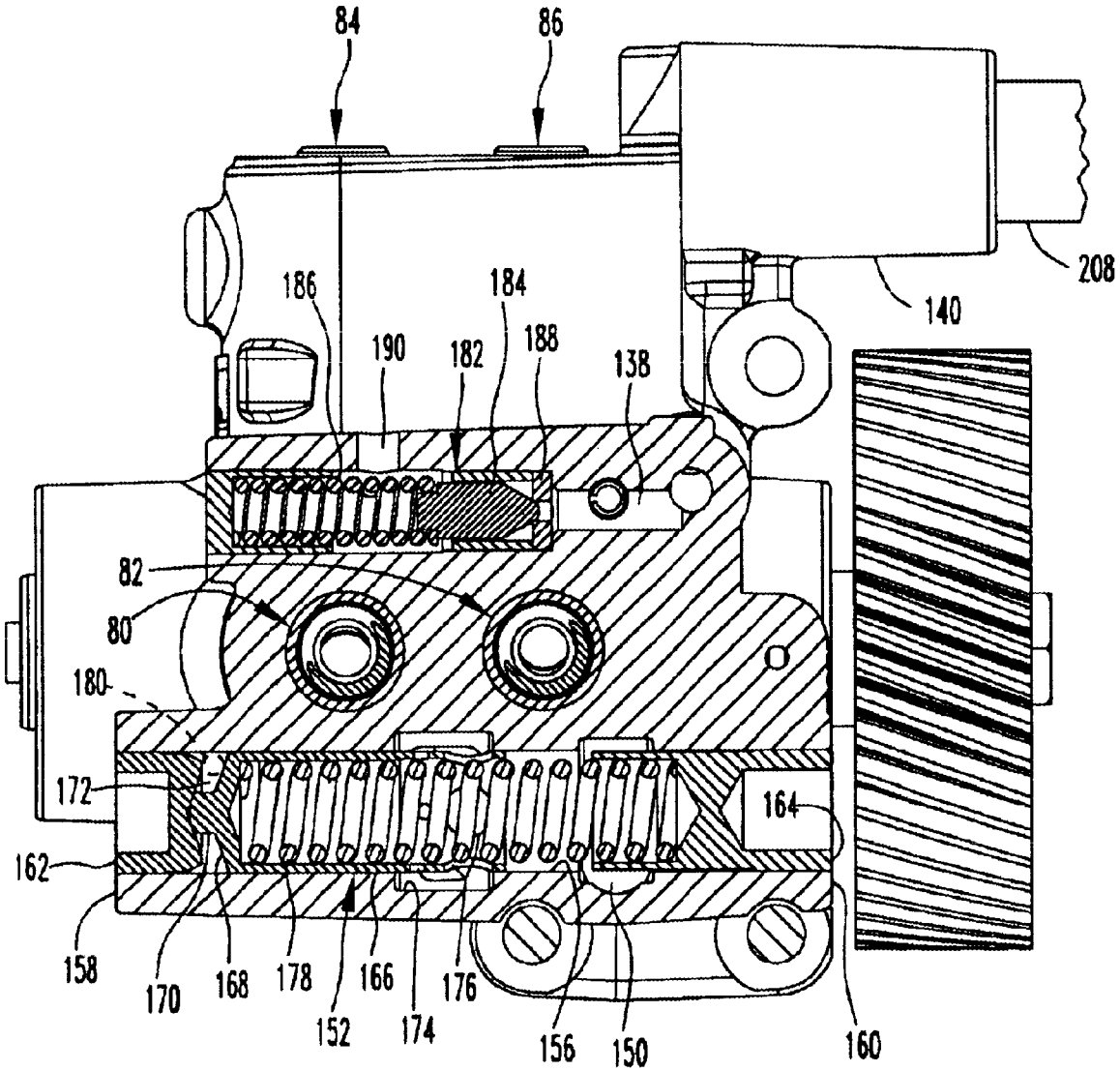
FIG. 8 is a partial sectional view taken along line 8—8 of FIG. 4.

High pressure mechanical relief valve 182 shown in FIG. 8 includes a valve member 184 held by spring 186 against valve seat 188. During over pressure situations, high pressure fluid in high pressure passage 138 moves the valve member away from seat 188 to permit discharge of high pressure fluid through outlet port 190 and into pump chamber 46 where the oil drains back into the engine sump.

Figure 9:
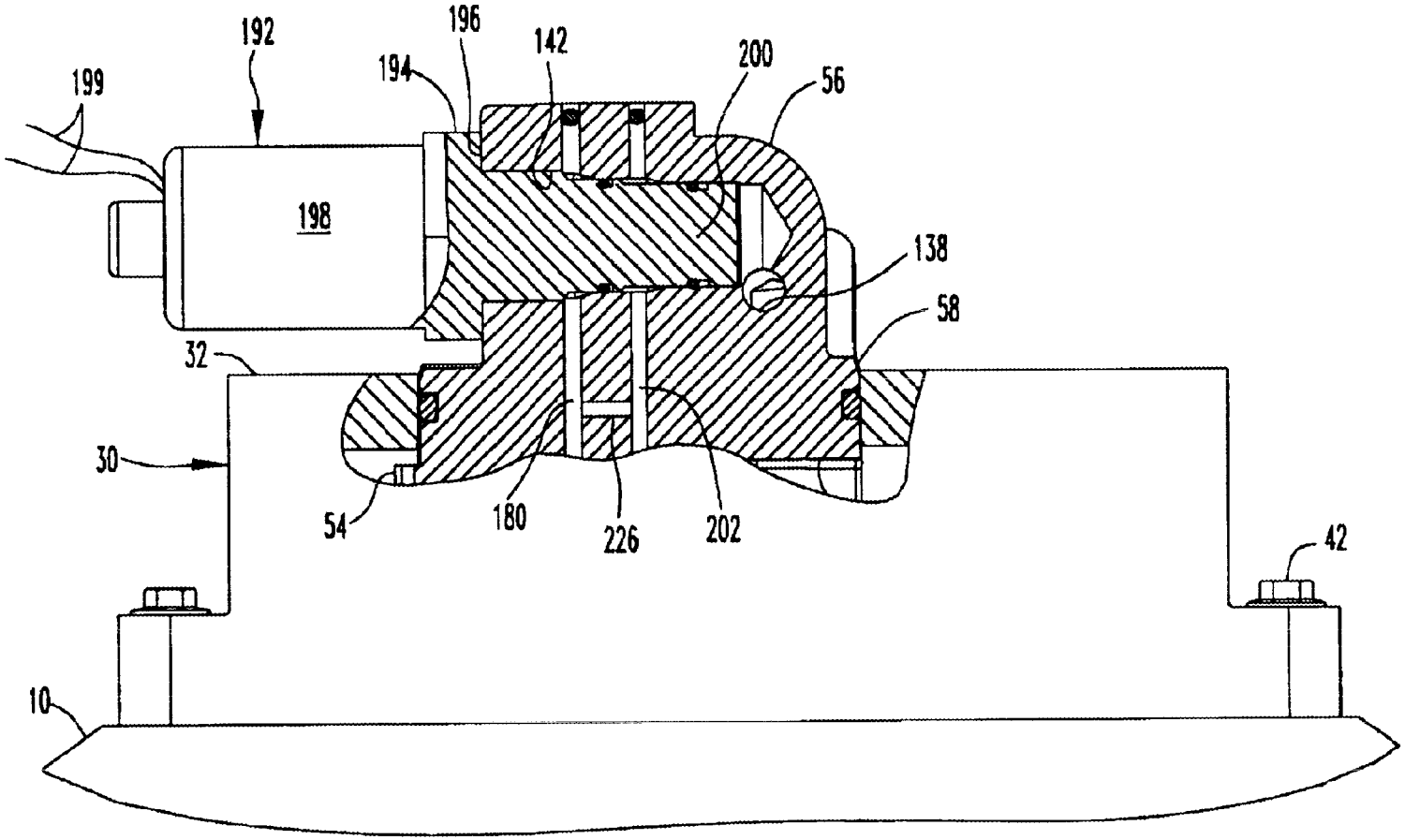
FIG. 9 is a partially broken away view taken along line 9—9 of FIG. 2.

Injection pressure regulating valve 192 is mounted on upper portion 56 of body 52, above flange 58, as shown in FIG. 9. The IPR valve 192 includes a base 194 mounted flush on vertical support surface 196 of upper portion 56, a solenoid 198 located outwardly from base 194 and a spool end 200 located inwardly from base 194 and fitted in spool recess 142 which opens in face 196. Leads 199 for solenoid 198 are connected to the electronic control module for engine 12. The IPR valve 192 and leads 199 are located outwardly from the pump chamber 46 to facilitate the servicing of the valve and routing and servicing of the leads outside of the pump chamber.

IPR valve 192 may be identical to the IPR valve disclosed in previously mentioned published PCT application No. WO 01/92709 A2.

The IPR spool end includes a main stage high pressure relief valve which opens in response to overpressure of the oil in the high pressure passage 138. Opening of the high pressure relief valve flows high pressure oil out from the spool end of the IPR valve and through discharge passage 202, shown in FIGS. 6 and 9 to chamber 102 surrounding crankshaft end 74. From chamber 102 the discharge oil lifts the lip of seal 100 and flows by gravity down into the end of block chamber 24 adjacent back wall 22. The discharged oil flows down through gear opening 28 and collects in the engine sump.

An amount of oil flowed to chamber 102 flows into the crankshaft through bore 114, along axial passage 112 and then through reduced cross sectional bore 116 into annular chamber 110 surrounding crank end 106. The oil in this chamber lifts the lip of seal 104 and flows into block chamber 24. The oil in chambers 102 and 110 provide lubrication for sleeve bearings 72 and 70. When the pressure of the oil in the crank chamber is greater than the pressure of the oil in chambers 102 and 110, the bearings are lubricated by oil from the crank chamber, conversely, when the pressure of the oil in the chambers 102 and 110 is greater than the pressure of the oil in the crank chamber, the bearings are lubricated by oil from the chambers. Slight flow of oil through the bearings and into the crank chamber does not affect operation of the pump.

The block includes a number of openings extending through the bottom of block chamber 24 into the interior of the block housing, the engine crankshaft, camshaft, tappets, push rods and other moving parts. One such opening 204 is shown in FIG. 6. Oil discharged from pump assembly 48 is preferably flowed back to the engine sump through the gear opening 28 located at the rear of the engine. It is desirable to limit the flow of return oil to the sump through passages located in the front end of the block chamber 24, such as passage 204. Relatively small cross section bore 116 restricts the flow of oil to the front annular chamber 110 to limit outward discharge of oil past seal 104 and limit of flow of return oil through forward passages 204 in the floor of the block chamber. The restriction may be provided in bore 114, rather than in bore 116, if desired. Alternatively, a restriction may be provided in axial passage 112.

Figure 10:
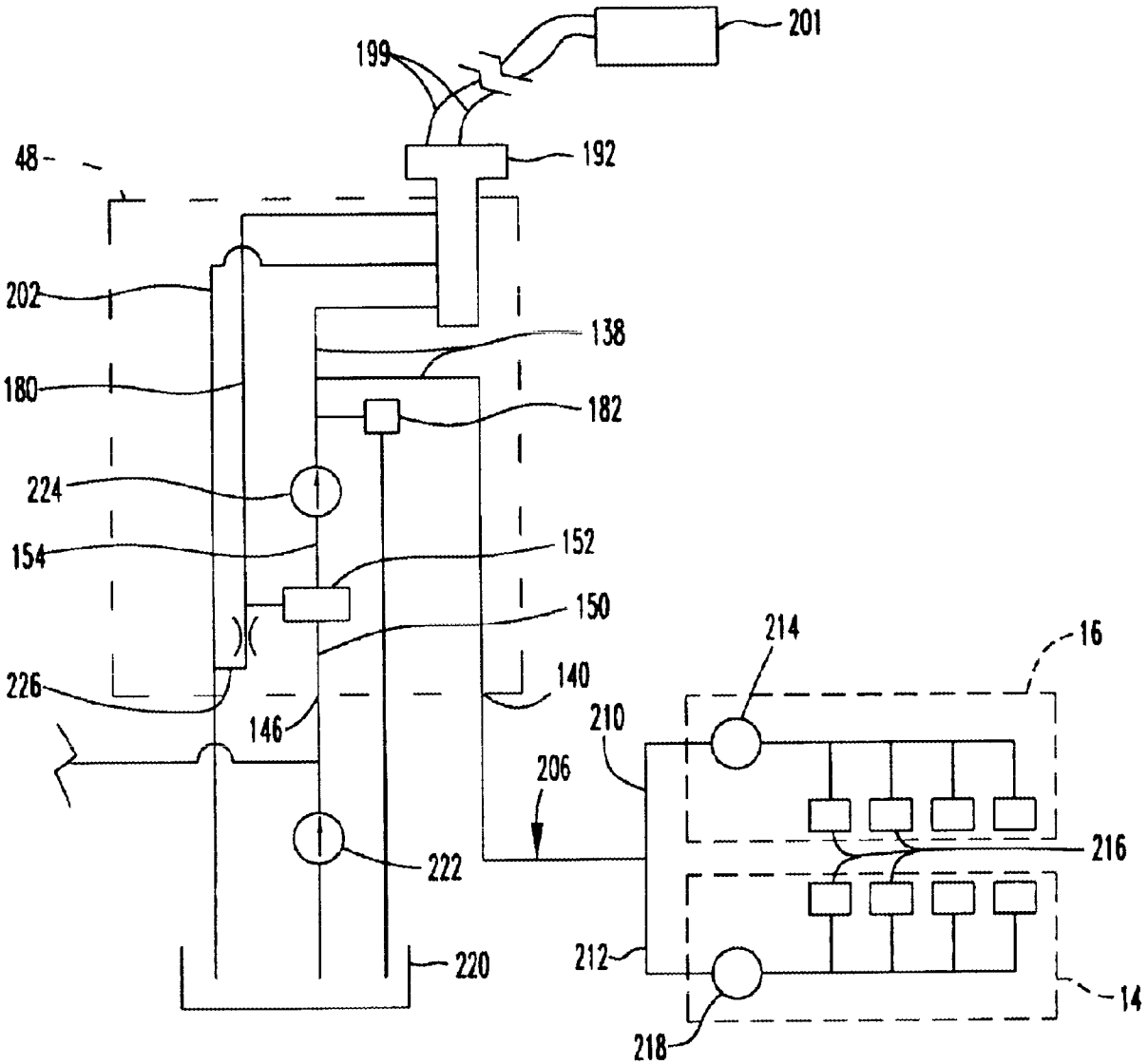
FIG. 10 is a hydraulic circuit diagram for the pump assembly.

As illustrated in FIG. 10, high pressure outlet pipe branch 210 is connected to an interior passage in left head 16 leading to high pressure rail 214 and to passages leading to the fuel injectors 216 for the left bank engine cylinders. Likewise, branch 212 of high pressure outlet tube 206 is connected to passages in right hand head 14 including high pressure rail 218 and HEUI injectors 216 for the head.

Pump assembly 48 is mounted on block 10 by positioning the assembly in the open block chamber 24 with gear 76 meshed with gear 26 and mounting flanges 65 positioned over corresponding bores in the block 10. Bolts 66 then mount the assembly on the floor of chamber 46. High pressure outlet tube 206 is secured to the assembly and to the right and left cylinder banks 14 and 16. Finally, cover 30 is fitted over the assembly with the opening 50 in the cover surrounding assembly flange 58. Resilient seal 60 extends outwardly from the flange a short distance to facilitate limited lateral shifting of the cover relative to the flange, if necessary. Bolts 42 secure the cover in place on block 10. Following mounting of the pump assembly in the block as described, leads 199 of IPR valve 192 are connected to the wiring harness for engine 10 to form connections with the electronic control module of the engine.

FIG. 10 illustrates the hydraulic circuitry for a pump assembly 48, which is identical to the hydraulic circuitry of the pump assembly disclosed in Published PCT Application WO 01/92709 A2, previously mentioned. The hydraulic circuit for HEUI engine 12 includes an engine oil sump 220, conventional low pressure pump 222 for flowing oil from the sump to bearings in the engine and flowing low pressure oil from the sump through inlet port 146 and branch 150 of the inlet passage to the inlet throttle valve 152. Oil passing through the inlet throttle valve flows through inlet passage branch 154 to the crank chamber 98 and thence to the four high pressure pumps 80, 82, 84 and 86, represented by symbol 224. The output of pumps 224 flows through high pressure outlet passage 138 to high pressure outlet port 140 and thence through tube 206 to heads 14 and 16 and injectors 216. High pressure oil from pumps 224 additionally flows through passage 138 to IPR valve 152 and to high pressure mechanical relief valve 182. Oil discharged from valve 182 returns to sump 220.

The main stage IPR valve reduces over pressures by flowing pumped oil back to the sump. The solenoid controlled IPR pilot valve controls opening and closing of the inlet throttle valve.

Opening of the solenoid controlled pilot valve in IPR valve 192 flows oil through passage 180 to chamber 172 in the inlet throttle valve 192 to shift the position of spool 166 and throttle the flow of inlet oil flowed to the four pumps 224. Bleed passage 226 extending between passages 180 and 202 bleeds oil from inlet throttle valve chamber 172 to permit movement of the spool toward the open position under the influence of spring 178.

During operation of engine 12 the IPR valve 192 controls the inlet throttle valve 152 to throttle the flow of low pressure oil supplied to pumps 224 so that the pressure of the pumped oil supplied to injectors 216 meets the instantaneous pressure requirements determined by engine control module 201 for the engine. Information concerning these requirements is supplied to the IPR solenoid through leads 199 to activate or deactivate the pilot control valve and control the pressure in passage 180.

The invention is useful in vee-type internal combustion engines where a pump assembly provides high pressure actuating fluid for solenoid controlled fuel injectors, solenoid controlled intake and exhaust valves or other hydraulically powered devices. In engines using two hydraulically actuated devices the control module for the engine maintains the pressure of the pumped fluid at the highest pressure required for either device.

Pump assembly 48 includes four crankshaft-driven high pressure pumps. The invention is not limited to pump assemblies with crankshaft-driven pumps but includes swash plate-type high pressure pumps and other types of high pressure pumps which may be used to pressurize fluid for actuating hydraulic fuel injectors, hydraulic intake and exhaust valve actuators and other hydraulically actuated devices used in internal combustion engines. For instance, the invention includes a pump assembly of the swash plate-type mounted in the pump chamber with the body extended through an opening in the cover of the pump chamber and with an IPR valve mounted on the top of the assembly, above and outside of the pump chamber.

The invention may also be used in mounting a high pressure pump assembly on an inline internal combustion engine, either diesel or gasoline, where the pump in the assembly is located in a chamber and the solenoid control valve for the assembly is located outside of the chamber.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim as our invention:

1. A pump assembly for pressurizing fluid for an internal combustion engine, the assembly comprising a body having a first, lower portion, a second, upper portion and a circumferential flange extending around the body between the first and second portions with the first portion below the flange; a crank chamber in the first portion of the body; a crankshaft mounted in the body, the crankshaft including a crank in the crank chamber and a drive end extending outwardly of the first portion of the body; a rotary drive member mounted on the drive end of the crankshaft for rotating the crankshaft in the body; a piston pump in the body, the pump including a first piston bore extending into the crank chamber, a first piston in the first bore, an operative connection between the crank and the piston for moving the piston back and forth in the bore in response to rotation of the crankshaft; an inlet port in the first portion of the body; a low pressure inlet passage in the body extending from the inlet port to the piston pump; an outlet port in the first portion of the body; a high-pressure outlet passage in the body extending from the pump to the outlet port; a solenoid controlled valve mounted on the second portion of the body; the high pressure outlet passage including a branch extending to the valve; a first passage in the body extending from the valve and into the first portion of the body; the valve including a solenoid operable to open and close the valve in response to electrical signals from an engine control module to control flow fluid from the outlet passage to the first passage; wherein the assembly may be mounted on an internal combustion engine in a pump chamber with the flange engaging a chamber cover; the rotary drive member, the inlet port, and the outlet port located inside the chamber and the valve located outside the chamber.

2. The assembly as in claim 1 wherein the second portion of the body includes a valve mounting face and a spool recess extending from the face into the body, and the valve includes a solenoid located outwardly of the body, a base engaging the face and a spool extending into the spool recess.

3. The assembly as in claim 2 wherein the spool recess is located entirely in the second portion of the body.

4. The assembly as in claim 3 wherein said valve mounting face extends away from the flange, and the spool recess extends perpendicular to the face.

5. The assembly as in claim 1 including an inlet throttle valve located in the inlet passage and wherein said first passage extends from the solenoid control valve to the inlet throttle valve.

6. The assembly as in claim 5 wherein the inlet throttle valve is located in the first portion of the body.

7. The assembly as in claim 1 wherein the first portion of the body includes a mounting base having an engagement surface facing away from the second portion of the body, and an opening for a mounting member extending through the mounting base.

8. The assembly as in claim 1 wherein said flange includes two opposed sides and curved sections joining said sides.

9. The assembly as in claim 1 wherein said first passage extends to an opening in the first portion of the body.

10. The assembly as in claim 1 wherein the crankshaft includes opposed ends, a lip seal mounted in the body at each end of the crankshaft, said seals each engaging one end of the crankshaft and including a lip facing outwardly from the body to permit flow of fluid outwardly along the crankshaft end; a pair of annular chambers, each chamber surrounding one end of the crankshaft inwardly of a seal; a passage extending along the length of the crankshaft, said passage sealed at the ends of the crankshaft; a first radial bore extending through a first crankshaft end and a second radial bore extending through a second crankshaft end, each bore communicating a surrounding annular chamber with said crankshaft passage; and a second passage in said body extending from the solenoid controlled valve to one of said annular chambers; wherein fluid flowed from said second passage flows from one annular chamber to the other annular chamber and flows out of said body past both said seals.

11. The assembly as in claim 10 wherein said second passage extends to an annular chamber surrounding a mounting end of the crankshaft and including a restriction, limiting flow from such annular chamber to the other annular chamber.

12. The assembly as in claim 10 wherein one of said radial bores is smaller than the other said radial bores.

13. An internal combustion engine comprising a block; a pump chamber on the block, the pump chamber having a floor, a circumferential wall extending around and above the floor and a cover; a drive gear opening in the pump chamber and a drive gear rotated by the engine in the gear opening; a pump opening in the chamber cover; an electronic control module located outwardly of the pump chamber; and a high-pressure pump assembly including a first portion located in the pump chamber, means for securing the first portion to the block, a shaft journaled in the first portion of the body, the shaft including a pump drive member and a drive end, such end extending outwardly from the first portion of the body within the gear opening; a driven gear mounted on said shaft drive end and engaging said drive gear so that rotation of the drive gear by the engine rotates the shaft; a piston pump in the body, the pump including a bore, a moveable piston in the bore and an operative connection between the piston and the pump drive member so that rotation of the shaft moves the piston back and forth in the bore; a low pressure inlet passage extending from the block through the first portion of the body to the pump; a high-pressure pump outlet passage extending from the pump through the first portion of the body, outwardly of the body and into the block; the body including a circumferential portion closely fitted to the opening in the cover to close the crank chamber; a valve mounting face on the body outside of the chamber; and a solenoid controlled valve mounted on said face with the valve solenoid outside of the chamber; said high-pressure passage including a branch extending through the second portion of the body to the valve; and a first passage extending from the valve through the second portion of the body and into the first portion of the body, said valve including solenoid leads located outside of the pump chamber.

14. The engine of claim 13 wherein said circumferential member comprises a flange.

15. The engine as in claim 13 wherein the cover includes sidewalls defining a cover chamber.

16. The engine as in claim 13 wherein said assembly body includes an upper portion located above the cover, said face formed in the upper portion.

17. The engine of claim 16 wherein the valve includes a spool located in the upper portion of the body.

18. The engine of claim 16 wherein the shaft includes a second end opposite said drive and, said ends located on opposite sides of the body, an annular seal mounted in said first portion surrounding each end of the crankshaft, each seal including an outwardly facing lip, an annular chamber surrounding each end of the crankshaft between a seal and the first portion of the body, the crankshaft including an axial passage and radial passage at each end extending from the axial passage to the adjacent annular chamber, said first passage opening into one of said annular chambers whereby fluid flowed through the valve and the first passage fills both chambers and flows outwardly of the pump assembly past both said seals.

19. The engine as in claim 18 wherein said first passage opens into the annular chamber adjacent the drive end of the crankshaft, and including a flow restriction located between such chamber and the chamber surrounding the other end of the crankshaft, wherein discharge of fluid past the seal surrounding the other end of the crankshaft is reduced.

* * * * *

UNITED STATES PATENT AND TRADEMARK OFFICE

CERTIFICATE OF CORRECTION

PATENT NO. : 6,669,453 B1
DATED : December 30, 2003
INVENTOR(S) : Breeden et al.

It is certified that error appears in the above-identified patent and that said Letters Patent is hereby corrected as shown below:

Column 1,
Line 27, delete “pump in”.
Line 40, replace “t h e” with -- the --.

Column 10,
Line 19, replace “and” with -- end --.

Signed and Sealed this

Second Day of March, 2004

JON W. DUDAS
*Acting Director of the United States Patent and Trademark Office*